US011139628B2

(12) United States Patent
Cai et al.

(10) Patent No.: US 11,139,628 B2
(45) Date of Patent: Oct. 5, 2021

(54) ELECTRICAL CONNECTOR AND METHOD OF MANUFACTURING THE SAME

(71) Applicant: LOTES CO., LTD, Keelung (TW)

(72) Inventors: Lun Cai, Keelung (TW); Quan Long, Keelung (TW); Da Zheng Qin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/862,991

(22) Filed: Apr. 30, 2020

(65) Prior Publication Data

US 2020/0403366 A1 Dec. 24, 2020

(30) Foreign Application Priority Data

Jun. 20, 2019 (CN) ..... 201910538226.X

(51) Int. Cl.
*H01R 43/16* (2006.01)
*H01R 13/405* (2006.01)
(Continued)

(52) U.S. Cl.
CPC ..... *H01R 43/16* (2013.01); *H01R 13/405* (2013.01); *H01R 13/646* (2013.01); *H01R 43/24* (2013.01);
(Continued)

(58) Field of Classification Search
CPC .. H01R 13/14; H01R 2107/00; H01R 24/525; H01R 24/60; H01R 24/76; H01R 25/162;
(Continued)

(56) References Cited

U.S. PATENT DOCUMENTS 6,155,886 A * 12/2000 Koseki ..... B29C 45/14639 439/736
6,371,817 B1 * 4/2002 Shi ..... H01R 43/24 439/660
(Continued)

FOREIGN PATENT DOCUMENTS

CN 2572601 Y 9/2003
CN 101728748 A 6/2010
(Continued)

*Primary Examiner* — Truc T Nguyen
(74) *Attorney, Agent, or Firm* — Locke Lord LLP; Tim Tingkang Xia, Esq.

(57) ABSTRACT

An electrical connector and a method of manufacturing the same are provided. A connecting member is embedded in an insulating body between a side edge of the insulating body and an outer side of a first terminal or a last terminal in a first terminal group, and a gap exists between the connecting member and the first terminal or the last terminal. In other words, the connecting member is not in contact with the first terminal or the last terminal adjacent to the connecting member. Thus, the width of the first terminal or the last terminal is not increased, ensuring the high-frequency transmission rate of the first terminal group, and thereby forming an electrical connector which is capable of facilitating machining without affecting the transmission quality of the terminals, and having a stable structure and high-frequency transmission performance.

20 Claims, 13 Drawing Sheets

(51) Int. Cl.

| | |
|---|---|
| ***H01R 13/646*** | (2011.01) |
| ***H01R 43/24*** | (2006.01) |
| *H01R 13/504* | (2006.01) |
| *H01R 13/6585* | (2011.01) |

(52) U.S. Cl.
CPC ..... *H01R 13/504* (2013.01); *H01R 13/6585* (2013.01)

(58) Field of Classification Search
CPC .... H01R 25/164; H01R 27/02; H01R 13/405; H01R 13/6205; H01R 13/6474; H01R 13/6581; H01R 13/6585; H01R 13/6596; H01R 43/16; H01R 43/24; H01R 12/585; H01R 12/7076; H01R 12/724; H01R 12/727; H01R 12/79; H01R 13/504; H01R 13/5202; H01R 13/521; H01R 13/5219; H01R 13/646; H01R 13/6461; H01R 13/6473; H01R 13/6586; H01R 13/6594; H01R 13/6691; H01R 2103/00; H01R 2201/06; H01R 24/40; H01R 24/64; H01R 43/0207; H01R 4/023; H01R 4/029; H01R 9/2666
See application file for complete search history.

(56) References Cited

U.S. PATENT DOCUMENTS

| | | | | |
|---|---|---|---|---|
| 9,755,336 | B2 * | 9/2017 | Cheng | H01R 43/16 |
| 2015/0111436 | A1 * | 4/2015 | Zhang | H01R 13/405 439/676 |
| 2015/0207272 | A1 * | 7/2015 | Ning | H01R 13/6594 439/78 |
| 2015/0357729 | A1 * | 12/2015 | Uratani | H01R 12/716 439/585 |
| 2015/0357735 | A1 * | 12/2015 | Uratani | H01R 12/716 439/660 |
| 2016/0118752 | A1 * | 4/2016 | Guo | H01R 12/71 439/78 |
| 2019/0052005 | A1 * | 2/2019 | Hasegawa | H01R 13/405 |
| 2019/0348784 | A1 * | 11/2019 | Yufu | H01R 12/75 |
| 2020/0412065 | A1 * | 12/2020 | Xu | H01R 13/405 |
| 2021/0013682 | A1 * | 1/2021 | Zhang | H01R 13/6581 |

FOREIGN PATENT DOCUMENTS

| | | | |
|---|---|---|---|
| CN | 201690022 | U | 12/2010 |
| CN | 107275828 | A | 10/2017 |
| CN | 108134227 | A | 6/2018 |

* cited by examiner

ELECTRICAL CONNECTOR AND METHOD OF MANUFACTURING THE SAME

CROSS-REFERENCE TO RELATED PATENT APPLICATION

This non-provisional application claims priority to and the benefit of, pursuant to 35 U.S.C. § 119(a), patent application Serial No. CN201910538226.X filed in China on Jun. 20, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and a method of manufacturing the same, and particularly to an electrical connector suitable for high-frequency transmission and a method of manufacturing the same.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An electrical connector is a conductor equipment mainly used for bridging two conductors on a loop, such that a current or a signal can flow from one of the conductors to the other conductor, and is widely applied to various electrical circuits to play the role of connecting or disconnecting the current or the signal. An existing electrical connector structure generally includes a terminal strip and an insulating body embedded and formed on the terminal strip. However, in the embedding and forming process, the terminal strip is easily impacted by a liquid insulating material and deviates from a preset position, thereby causing the connection between the terminal strip and the injection-molded insulating body to be not firm. To solve the deficiency, the skilled in the art may generally provide an additional auxiliary supporting leg connected with the side edge of the terminal strip on the terminal strip formed by punching to further strengthen the fixation between the terminal strip and the insulating body. For example, the Chinese Patent Publication No. CN201690022U discloses a connector terminal support structure, in which two terminals located at the outermost sides among the terminals are provided with auxiliary supporting legs 34, a support frame body extends inward to form supporting pins 33 connected with the auxiliary supporting legs 34, and breaking lines 31 are provided between the supporting pins 33 and the auxiliary supporting legs 34. The supporting pins 33 are molded in advance. When a plastic seat and the terminals are assembled, the supporting pins 33 only need to be punched to be broken. However, the technology has the following deficiencies. Firstly, the auxiliary supporting legs 34 are connected with the terminals located at the outermost sides. After the insulating body is injection-molded on the terminals and the support is removed, the auxiliary supporting legs 34 are always connected to the terminals located at the outermost sides, and the two are embedded in an insulating body altogether, which is equivalent to the increment in the widths of the terminals at the outer sides, thereby increasing the characteristic impedance value and easily reducing the transmission rates of signal terminals during practical use, such that the electrical connector cannot achieve the high-frequency performance.

Therefore, a heretofore unaddressed need to design a novel electrical connector and a manufacturing method thereof exists in the art to address the aforementioned deficiencies and inadequacies.

SUMMARY

The present invention is directed to an electrical connector that does not affect the transmission rate of terminals and a method of manufacturing the same, by providing a connecting member embedded between a side edge of an insulating body and an outer side of a first terminal or a last terminal of the terminals on a first terminal group, and forming a gap between the connecting member and the first terminal or the last terminal.

To achieve the foregoing objective, the present invention adopts the following technical solutions.

An electrical connector includes: a first terminal group, having a plurality of terminals provided thereon; and an insulating body, covering the first terminal group by insert molding, wherein at least one of the terminals on the first terminal group is provided with a first strip connecting portion protruding out of a rear end of the insulating body, a connecting member is provided between a first terminal or a last terminal of the terminals on the first terminal group and a corresponding side edge of the insulating body adjacent thereto, the connecting member and the first terminal group are made of a same material, the connecting member is embedded into the insulating body and has two sides, one of the two sides of the connecting member is exposed to the corresponding side edge of the insulating body, a gap exists between the connecting member and the first terminal or the last terminal on the first terminal group adjacent to the other of the two sides of the connecting member in a lateral direction, and the connecting member has a second strip connecting portion exposed to the corresponding side edge of the insulating body.

In certain embodiments, the connecting member has a main body portion and at least one wing portion protruding from the main body portion, and the insulating body is formed with a stopping portion between the wing portion and the corresponding side edge of the insulating body.

In certain embodiments, the wing portion is formed by protruding from at least one of a plurality of edges of the main body portion, the second strip connecting portion is formed by protruding from another one of the edges of the main body portion, and the wing portion and the main body portion are located on a same plane.

In certain embodiments, the connecting member has two wing portions, the two wing portions respectively protrude from a front edge and a rear edge of the main body portion, and two side edges of the insulating body are correspondingly provided with two stopping portions.

In certain embodiments, a protruding direction of the second strip connecting portion and a protruding direction of the wing portion are perpendicular to each other.

In certain embodiments, a protruding direction of the first strip connecting portion and a protruding direction of the second strip connecting portion are perpendicular to each other.

In certain embodiments, the connecting member and the first terminal group are formed by punching a same metal sheet.

In certain embodiments, the connecting member is provided with at least one through hole, and the insulating body is integrally formed with an engaging portion located in the through hole to stop the connecting member from detaching away from the corresponding side edge of the insulating body.

In certain embodiments, the insulating body comprises a base and a first tongue extending from the base, the first terminal group has a plurality of signal terminals and a plurality of ground terminals, and the first terminal or the last terminal on the first terminal group is one of the signal terminals.

In certain embodiments, structures of the signal terminals are identical, and structures of the ground terminals are identical.

In certain embodiments, each of the signal terminals has a retaining portion embedded in the base, the connecting member is located between the retaining portion and the corresponding side edge of the insulating body, and a width of the retaining portion of each of the signal terminals is identical.

In certain embodiments, the electrical connector further includes a second terminal group provided below the first terminal group, wherein an insulating seat covers the second terminal group by insert molding, the insulating seat is located at a bottom of the insulating body, and at least one of a plurality of terminals on the second terminal group is provided with a third strip connecting portion protruding out of a rear end of the insulating seat.

In certain embodiments, the electrical connector further includes a shielding sheet accommodated in the insulating body, wherein the shielding sheet is located below the first terminal group to be clamped between the first terminal group and the second terminal group, the connecting member is located above the shielding sheet, and a clearance exists between the connecting member and the shielding sheet in a vertical direction.

In certain embodiments, an insulating shell covers the insulating body, the shielding sheet and the insulating seat by over molding, at least one of the terminals on the first terminal group has a first contact portion exposed to an upper surface of the insulating shell, at least one of the terminals on the second terminal group has a second contact portion exposed to a lower surface of the insulating shell, the first strip connecting portion and the third strip connecting portion protrude out of a rear end of the insulating shell, and a front end of the insulating shell is provided with a foolproof member extending forward.

In certain embodiments, each of the first contact portions of the terminals on the first terminal group extends forward to form a pre-breaking portion to be connected to a strip bridge, and the pre-breaking portion is exposed out of the insulating body and is embedded in the insulating shell.

A method manufacturing an electrical connector includes: S1: providing a metal sheet, and manufacturing a first terminal group and at least one connecting member on the metal sheet by punching and blanking, wherein the connecting member is located at an outer side of a first terminal or a last terminal of a plurality of terminals on the first terminal group, a gap exists between the connecting member and the first terminal or the last terminal on the first terminal group adjacent to the connecting member, two ends of at least one of the terminals on the first terminal group are respectively provided with a pre-breaking portion and a first strip connecting portion, the first strip connecting portion is connected with a first strip, the pre-breaking portion is connected with a strip bridge, the connecting member has a second strip connecting portion and is connected with a second strip, and the strip bridge is connected with the second material strip; S2: after placing the first terminal group in a mold cavity and positioning the strip bridge and the second strip, forming an insulating body on the first terminal group and the connecting member by insert molding for a first time, wherein the connecting member is embedded between a corresponding side edge of the insulating body and the first terminal or the last terminal of the terminals on the first terminal group adjacent to the connecting member, the second strip connecting portion is exposed to the side edge of the insulating body, the pre-breaking portion is exposed to a front end of the insulating body, and the first strip connecting portion protrudes out of a rear end of the insulating body; and S3: removing the strip bridge and/or the first strip.

In certain embodiments, in the step S1, the connecting member has a main body portion and at least one wing portion formed by protruding from at least one of a plurality of edges of the main body portion, and the second strip connecting portion is formed by protruding from another one of the edges of the main body portion; and in the step S2, the insulating body is formed with a stopping portion between the wing portion and the corresponding side edge of the insulating body.

In certain embodiments, in the step S3, the strip bridge is removed; and the method further comprises, after the step S3, a step S4: placing the insulating body and the first terminal group on a mold, and forming an insulating shell to cover the insulating body and the first terminal group by over molding for a second time, wherein the second strip connecting portion is exposed to a side edge of the insulating shell, and the pre-breaking portion is embedded in the insulating shell.

In certain embodiments, in the step S2, a shielding sheet is provided below the first terminal group, and the shielding sheet and the first terminal group are embedded in the insulating body altogether; and in the step S4, the insulating shell covers the shielding sheet, the first terminal group and the insulating body.

In certain embodiments, prior to the step S4, a second terminal module is provided, and the second terminal module comprises a second terminal group and an insulating seat formed on the second terminal group by insert molding; in the step S4, the insulating shell covers the first terminal group, the insulating body, the shielding sheet, the second terminal group and the insulating seat; and the method further comprises, after the step S4, a step S5: removing the second strip.

Compared with the related art, in the electrical connector according to certain embodiments of the present invention, at least one connecting member is embedded between the outer side of the first terminal or the last terminal on the first terminal group and the corresponding side edge of the insulating body. A gap is formed between the connecting member and the first terminal or the last terminal adjacent to the connecting member.

With such structural design, the connecting member is convenient to position the first terminal group so as to ensure that the insulating body has a relatively good molding effect. Further, the gap is formed between the connecting member and the first terminal or the last terminal adjacent to the connecting member. That is, the connecting member is not in contact with the first terminal or the last terminal adjacent to the connecting member, and does not increase the width of the first terminal or the last terminal, thus ensuring the high-frequency transmission rate of the first terminal group. Therefore, the electrical connector can be formed without affecting the transmission quality of the terminals, which is capable of facilitating machining, stable in structure and has high-frequency transmission performance.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
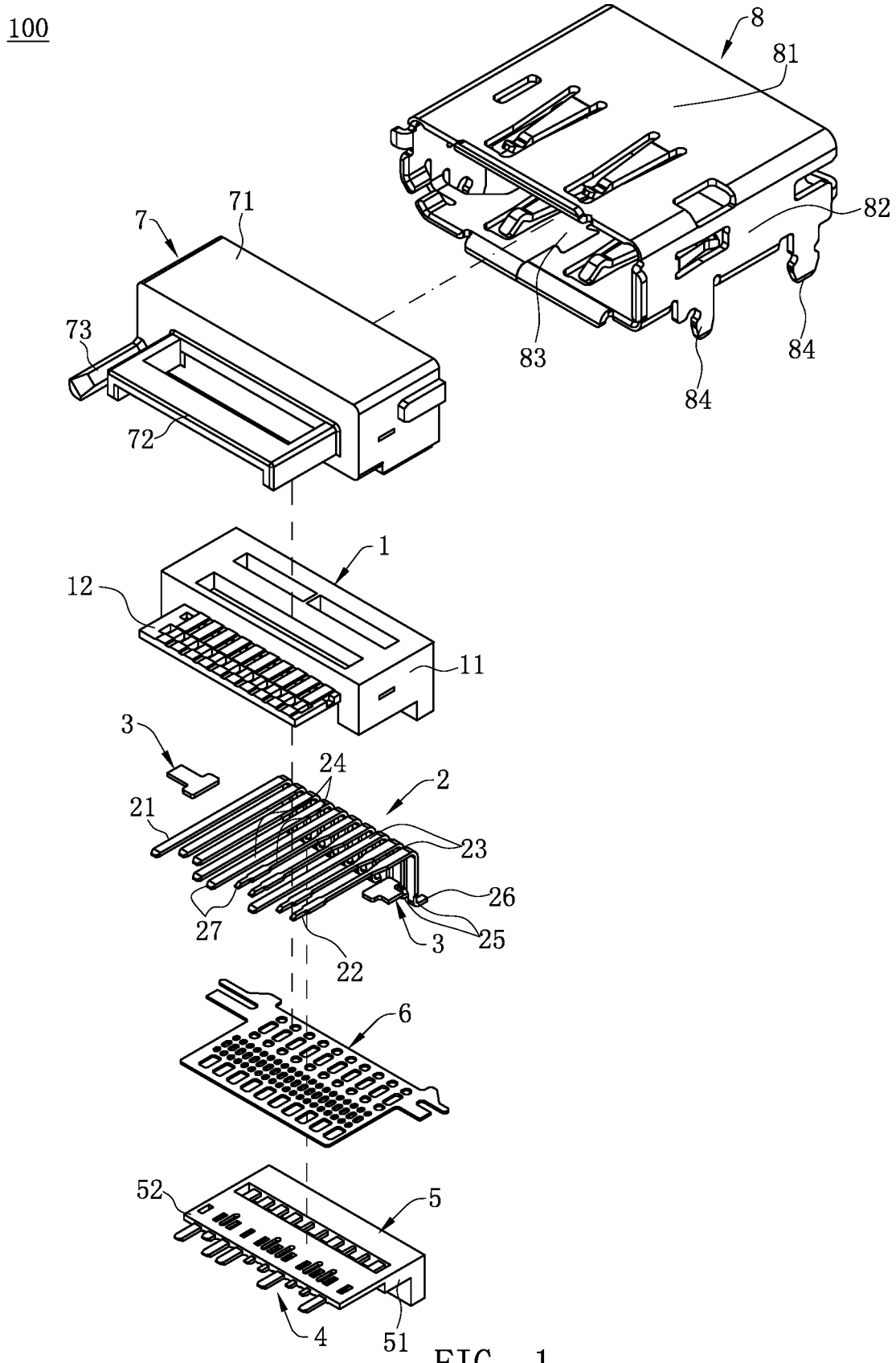
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-13. In accordance with the purposes of this invention, as embodied and broadly described herein, this invention, in one aspect, relates to an electrical connector and a method of manufacturing the same.

FIG. 1 shows a first embodiment of the present invention, in which an electrical connector 100 is used to be mounted on a circuit board (not shown in the drawings) to transmit a high-frequency signal. The electrical connector 100 is a DP electrical connector. The electrical connector 100 mainly includes a first terminal group 2, a connecting member 3 and a shielding sheet 6 embedded in an insulating body 1, a second terminal group 4 embedded in an insulating seat 5, an insulating shell 7 formed on the insulating body 1 and the insulating seat 5, and a shielding shell 8 covering the insulating shell 7.

Figure 2:
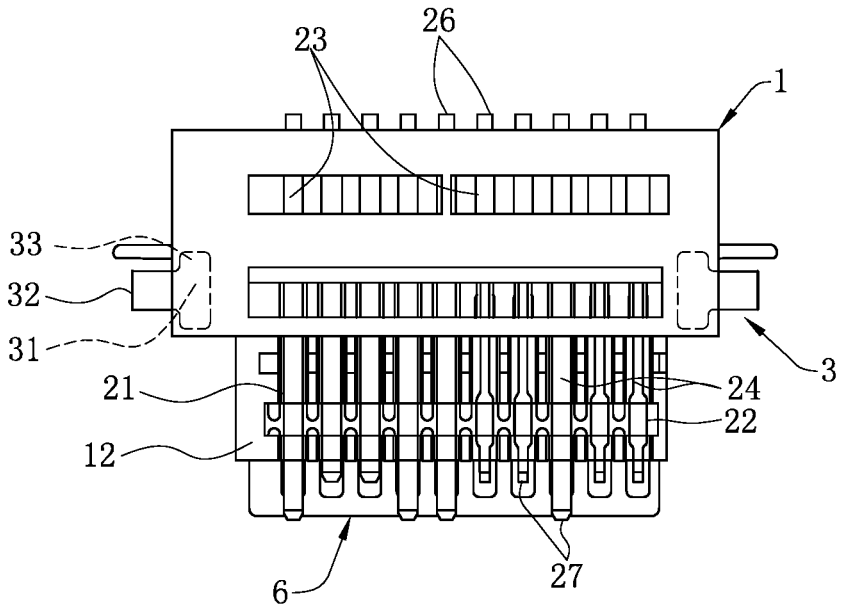
FIG. 2 is a structural schematic view of an assembly of an insulating body and a first terminal group according to the first embodiment of the present invention.
Figure 3:
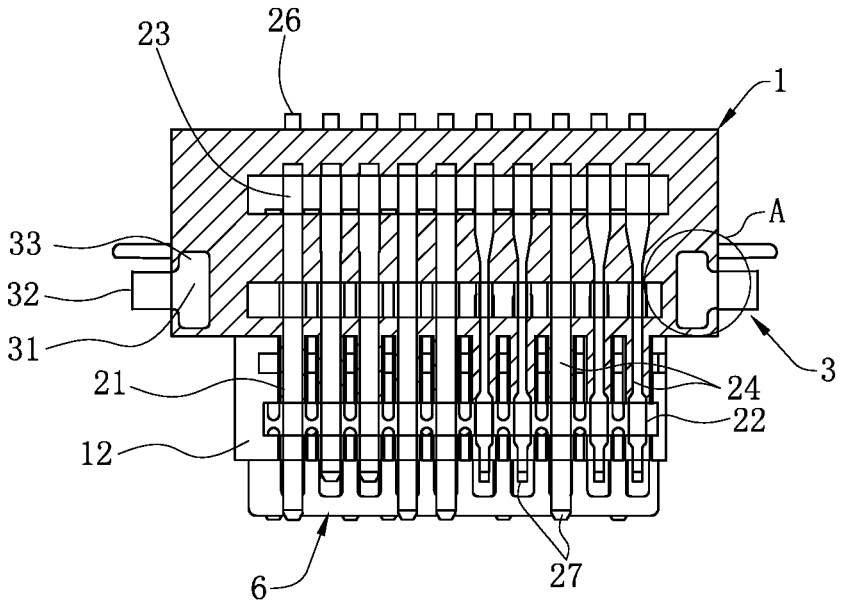
FIG. 3 is a sectional view of FIG. 2.
Figure 4:
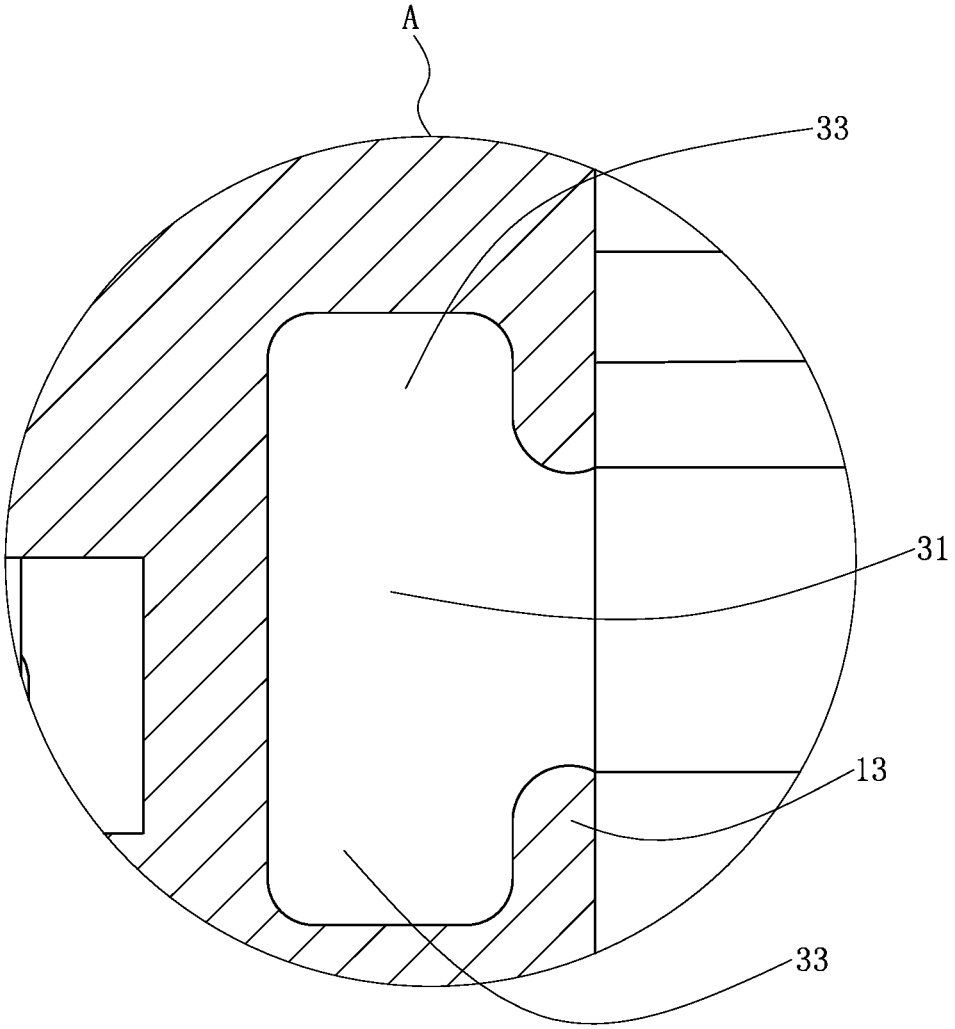
FIG. 4 is a partially enlarged view of a portion A in FIG. 3.

Specifically, as shown in FIG. 2 and FIG. 3, the insulating body 1 is mainly made of a plastic material, and includes a base 11 in a rectangular shape, and a first tongue 12 extending forward from a front end of the base 11. The insulating body 1 is formed on the first terminal group 2 by insert molding.

As shown in FIG. 1, FIG. 2 and FIG. 3, a first terminal group 2 having a plurality of terminals is provided thereon. The first terminal group 2 is composed of a plurality of signal terminals 21 and a plurality of ground terminals 22. The signal terminals 21 and the ground terminals 22 are arranged in a row along a lateral direction perpendicular to a front-rear direction. In the present embodiment, five of the signal terminals 21, two of the ground terminals 22, one of the signal terminals 21 and two of the ground terminals 22 are sequentially arranged on the first terminal group 2 at an equal distance. In other embodiments, the signal terminals 21 and the ground terminals 22 on the first terminal group 2 can be arranged according to standards of other products. Each of the signal terminals 21 and the ground terminals 22 sequentially includes, forward from the rear thereof, a first soldering portion 25, a retaining portion 23, a first contact portion 24 and a pre-breaking portion 27. The first soldering portion 25 protrudes out of a rear end of the base 11. A rear end of the first soldering portion 25 is provided with a first strip connecting portion 26 and a broken line convenient to break. The retaining portion 23 bends downward and is retained in the base 11. The first contact portion 24 is exposed to an upper surface of the first tongue 12. The pre-breaking portion 27 protrudes out of a front end of the first tongue 12. The pre-breaking portion 27 and a pre-breaking portion 27 at one adjacent side thereof are arranged in the front-rear direction. The structures of all of the signal terminals 21 are identical, and the structures of all of the ground terminals 22 are identical.

In the present embodiment, the first terminal of the first terminal group 2 is a signal terminal 21, and the last terminal of the first terminal group 2 is a ground terminal 22. A connecting member 3 formed by punching the same metal sheet that also forms the first terminal group 2 is embedded between the retaining portion 23 of each of the first terminal and the last terminal and a corresponding side edge of the base 11 adjacent to the retaining portion 23. Each connecting member 3 has two sides, and one of the two sides of the connecting member 3 is exposed to the corresponding side edge of the base 11. A gap is formed between each of the two connecting members 3 and each of the first terminal and the last terminal on the first terminal group 2 adjacent to the other of the two sides of the corresponding connecting member 3 in a lateral direction. Each of the two connecting members 3 has a main body portion 31, and the main body portion 31 has a front edge and a rear edge opposite to each other and two side edges connecting the front edge and the rear edge. One of the side edges of the main body portion 31 extend to form a second strip connecting portion 32 protruding out of the side edge of the corresponding base 11 along the lateral direction. In addition, a protruding direction of the second strip connecting portion 32 is perpendicular to a protruding direction of the first strip connecting portion 26. An end of the second strip connecting portion 32 has a broken line convenient to break. The main body portion 31 further has two wing portions 33 respectively protruding from a front edge and a rear edge of the main body portion 31. The protruding direction of the second strip connecting portion 32 is perpendicular to a protruding direction of each of the wing portions 33. The two wing portions 33, the second strip connecting portion 32 and the main body portion 31 are located on a same plane. A stopping portion 13 is formed between each of the wing portions 33 and the corresponding side edge of the base 11. That is, two side edges of the base 11 along the lateral direction are respectively provided with two stopping portions 13 to respective stop the two wing portions 33.

Figure 9:
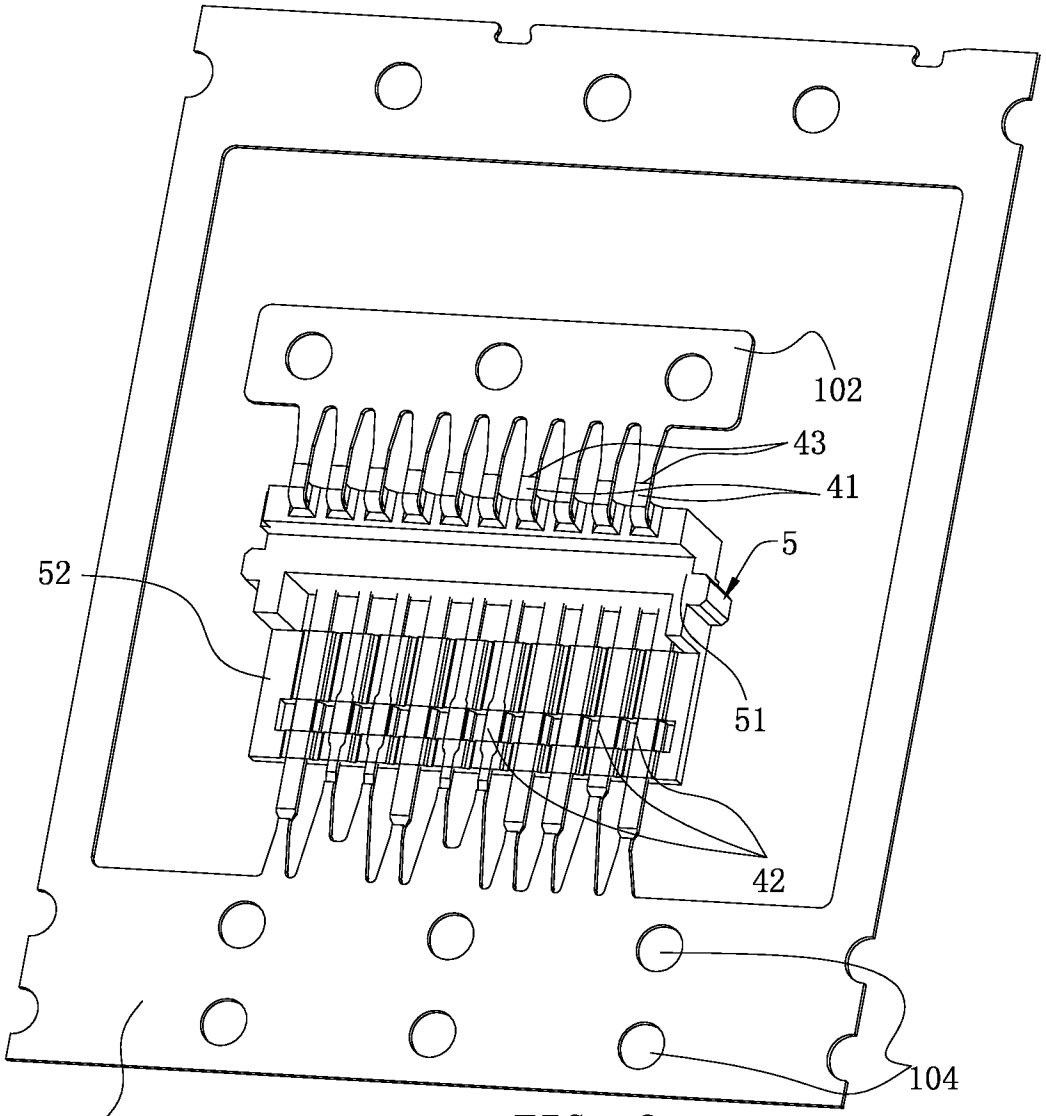
FIG. 9 is a structural schematic view of an insulating seat being injection-molded on a second terminal group in step S2 according to the first embodiment of the present invention.
Figure 10:
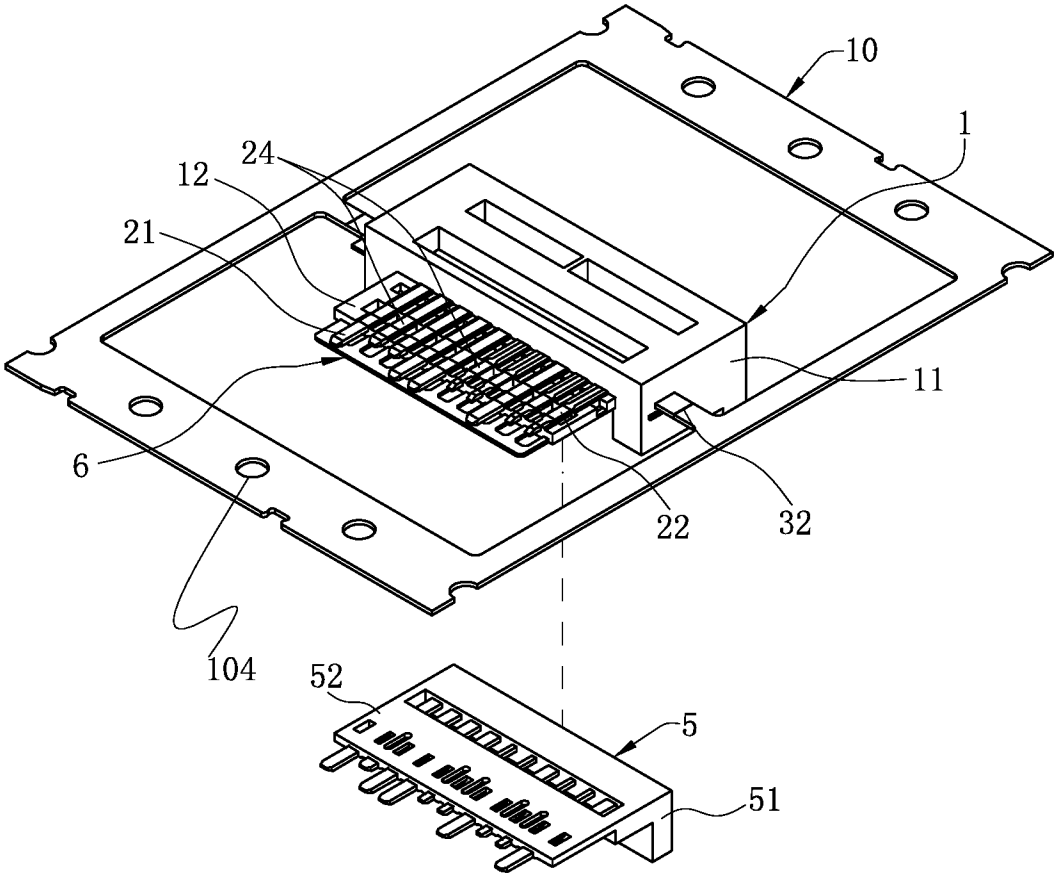
FIG. 10 is a structural schematic view of a first terminal module and a second terminal module in step S2 according to the first embodiment of the present invention.

In addition, as shown in FIG. 9 and FIG. 10, the electrical connector 100 further includes a second terminal module provided below the first terminal group 2. The second terminal module includes the second terminal group 4 and an insulating seat 5 injection-molded on the second terminal group 4. The second terminal group 4 is composed of a plurality of signal terminals 21 and a plurality of ground terminals 22. The structures of the signal terminals 21 and the ground terminals 22 in the second terminal group 4 are similar to those of the signal terminals 21 and the ground terminals 22 in the first terminal group 2. Four of the signal terminals 21, two of the ground terminals 22, one of the signal terminals 21, two of the ground terminals 22 and one of the signal terminals 21 are sequentially arranged in the second terminal group 4 at an equal distance. In other embodiments, the signal terminals 21 and the ground terminals 22 on the second terminal group 4 can be arranged according to standards of other products. The signal terminals 21 and the ground terminals 22 are arranged in a row along the lateral direction. Each of the signal terminals 21 and the ground terminals 22 includes a second contact portion 42 and a second soldering portion 41. The second terminal group 4 is embedded in the insulating seat 5. The insulating seat 5 is mainly made of plastics and includes a base seat 51 in a rectangular shape, and a second tongue 52 extending forward from a front end of the base seat 51. The second contact portion 42 is exposed to a lower surface of the second tongue 52. A front end of the second contact portion 42 protrudes out of a front end of the second tongue 52. The second soldering portion 41 protrudes out of a rear end of the base seat 51. A rear end of the second soldering portion 41 is provided with a third strip connecting portion 43 and a broken line convenient to break. In the second terminal group 4, the structures of all of the signal terminals 21 are identical, and the structures of all of the ground terminals 22 are identical. In addition, the second terminal group 4 and the first terminal group 2 are staggered in the vertical direction.

As shown in FIG. 1, FIG. 2 and FIG. 3, the electrical connector 100 further includes a shielding sheet 6 provided below the first terminal group 2. The shielding sheet 6 is clamped between the first terminal group 2 and the second terminal group 4 and is embedded in the insulating body 1. A front end of the shielding sheet 6 protrudes out of the front end of the first tongue 12. The wing portions 33 are located above the shielding sheet 6, and a clearance is formed between each of the wing portions 33 and the shielding sheet 6 in a vertical direction.

Figure 5:
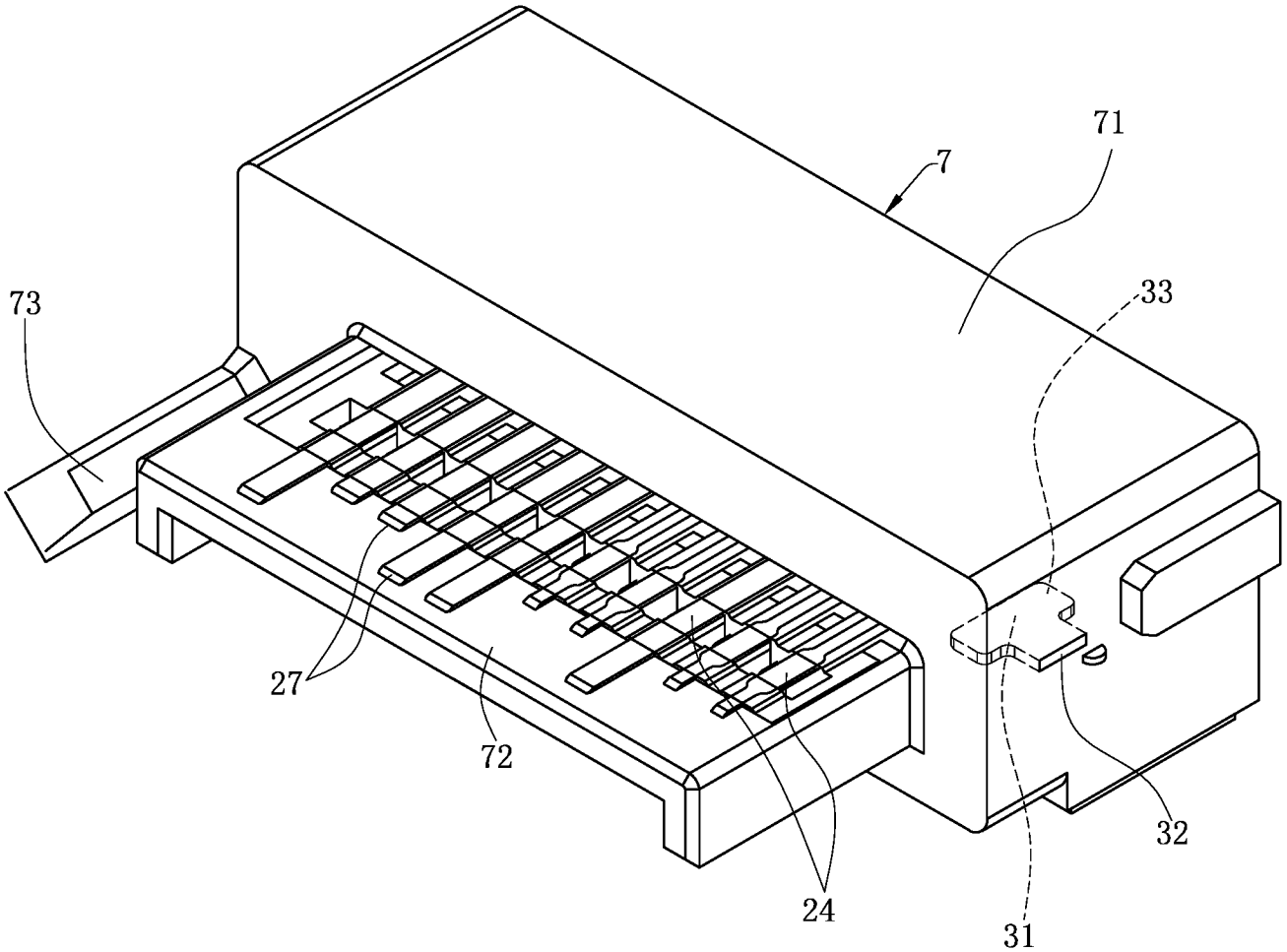
FIG. 5 is a perspective assembled view of an insulating shell, a connecting member and the first terminal group according to the first embodiment of the present invention.
Figure 6:
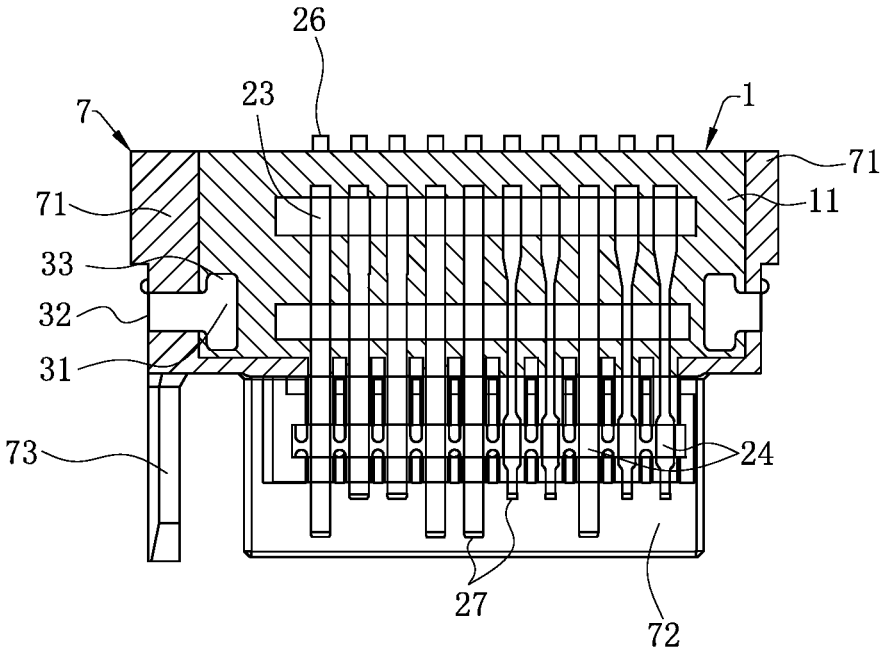
FIG. 6 is a sectional view of FIG. 5.

Further, as shown in FIG. 1, FIG. 5 and FIG. 6, the electrical connector 100 further includes the insulating shell 7. The insulating shell 7 is mainly made of plastics and includes a matrix 71 in a rectangular shape, and a third tongue 72 extending forward from the matrix 71. The insulating shell 7 covers the insulating body 1, the first terminal group 2, the shielding sheet 6, the second terminal group 4 and the insulating seat 5. The matrix 71 covers the base 11 and the base seat 51. The first soldering portion 25 and the second soldering portion 41 protrude out of a rear end of the matrix 71 so as to be soldered with the circuit board (not shown). The two second strip connecting portions 32 are respectively exposed to the two side edges of the matrix 71 along the lateral direction. The third tongue 72 covers the first tongue 12 and the second tongue 52. The first contact portion 24 is exposed to an upper surface of the third tongue 72. The pre-breaking portion 27 protrudes out of the front end of the first tongue 12 and is embedded in the third tongue 72. The second contact portion 42 is exposed to the lower surface of the third tongue 72. In addition, the front end of the matrix 71 is further provided with a foolproof member 73 extending forward and in a strip shape. The foolproof member 73 is used to avoid inversed-plugging operation when the electrical connector 100 is plugged in a mating connector (not shown in the drawings).

As shown in FIG. 1, the electrical connector 100 further includes a shielding shell 8 made of a metal material to cover the insulating shell 7. The shielding shell 8 includes an upper wall 81, a lower wall (not numbered) and two side walls 82 connected with the upper wall 81 and the lower wall. The upper wall 81, the lower wall and the two side walls 82 surroundingly enclosed outside the insulating shell 7 to form a plug-in opening 83. A rear end of the upper wall 81 is flushed with the rear end of the matrix 71. The two side walls 82 extend backward to form a bending buckle (not shown in the drawings) to be clamped at the rear end of the matrix 71. A notch (not shown in the drawings) is formed on the lower wall so as to allow the first soldering portion 25 and the second soldering portion 41 to protrude to be soldered on the circuit board. In addition, the two side walls 82 have a total of four soldering legs 84 symmetrically extending downward to solder the shielding shell 8 on the circuit board for grounding.

Figure 12:
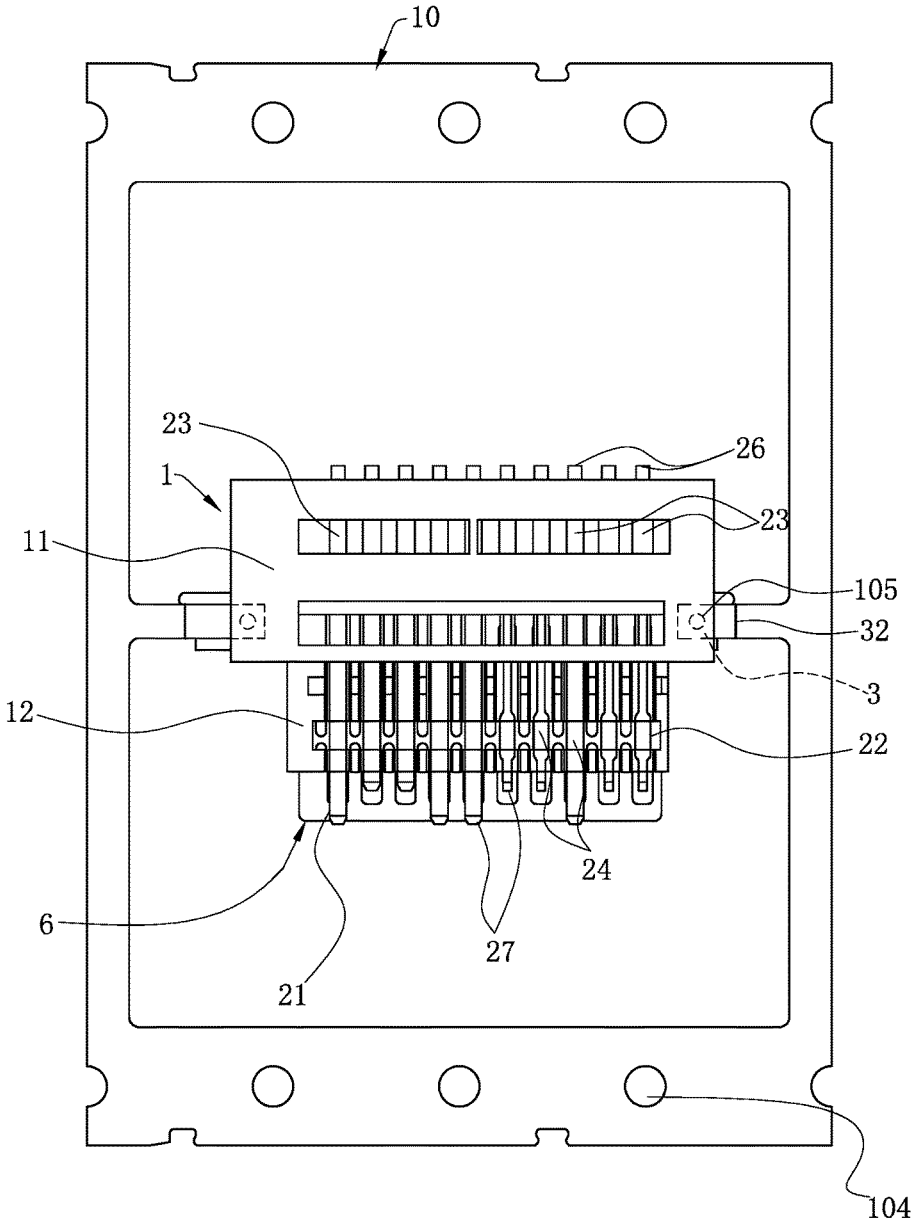
FIG. 12 is a structural schematic view of the insulating body being injection-molded on the first terminal group according to a second embodiment of the present invention.
Figure 13:
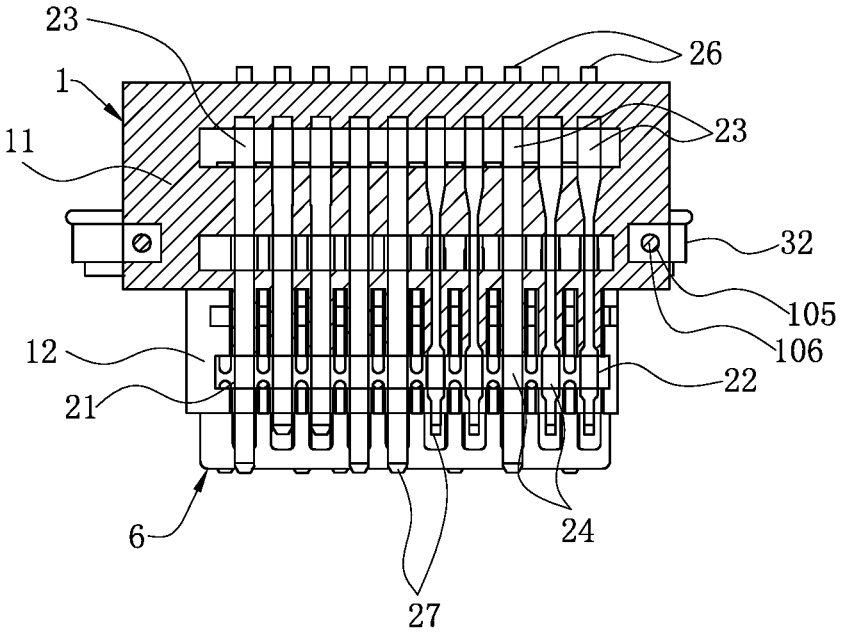
FIG. 13 is a sectional view of FIG. 12.

FIG. 12 and FIG. 13 show a second embodiment of the present invention. The difference between the second embodiment and the first embodiment exists in that a through hole 105 is formed in the connecting member 3, and an engaging portion 106 is integrally formed in the base 11 and is located in the through hole 105 to stop the connecting member 3 from breaking away from the side edge of the base 11. Other structures in the second embodiment are identical to those in the first embodiment.

To facilitate the understanding of the skilled in the art, a method of manufacturing the electrical connector 100 in the first embodiment is described as follows.

Figure 7:
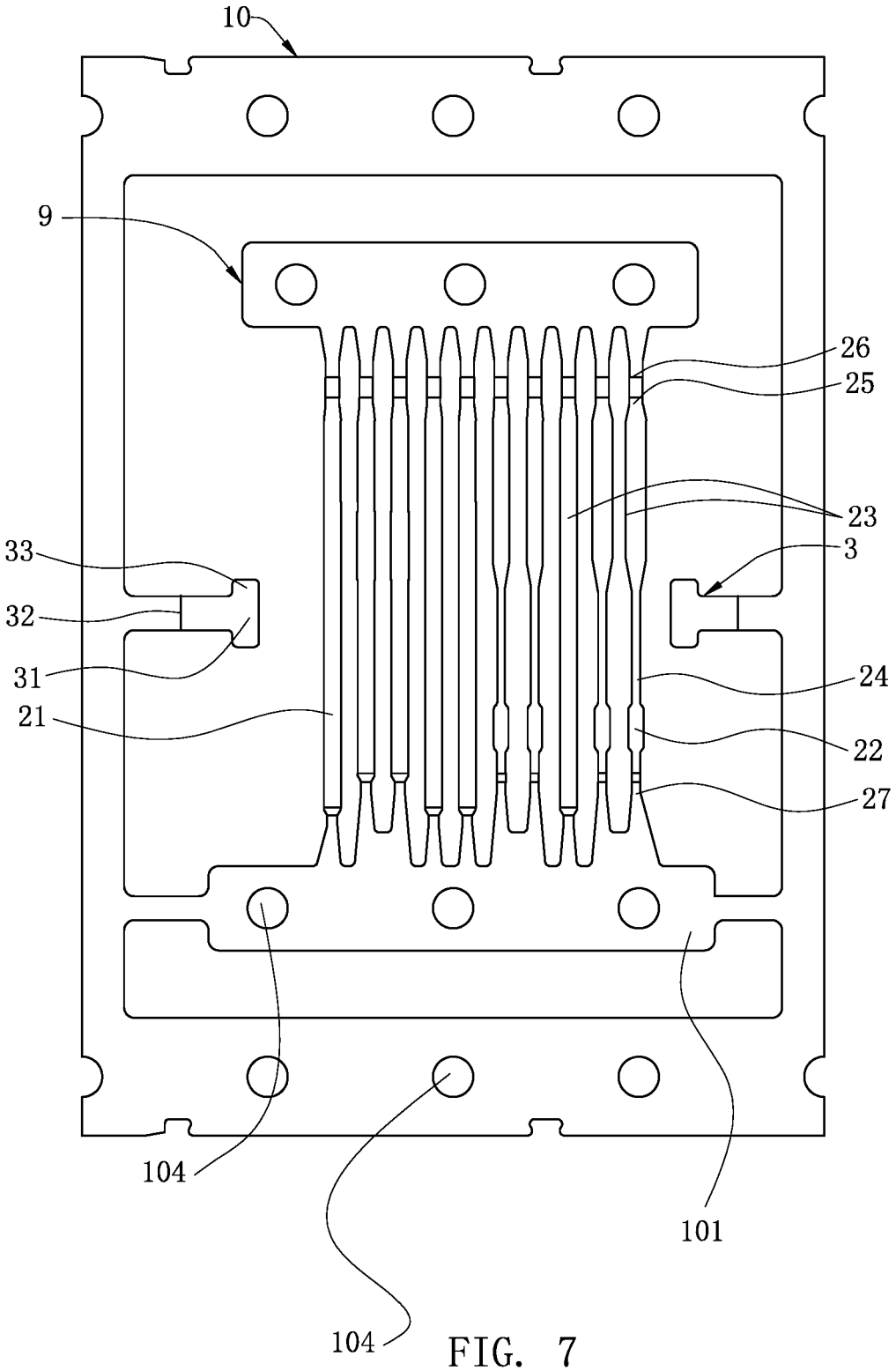
FIG. 7 is a structural schematic view of the first terminal group in step S1 according to the first embodiment of the present invention.

S1: as shown in FIG. 7, a metal sheet is provided, and a first terminal group 2 and the two connecting members 3 are manufactured on the metal sheet by punching and blanking. The two connecting members 3 are respectively located at outer sides of the first terminal and the last terminal on the first terminal group 2. Each connecting members 3 has two sides. A gap is formed between each of the two connecting members 3 and each of the first terminal and the last terminal on the first terminal strip 2 adjacent to one of the two sides of the connecting member 3 in a lateral direction. Each of the connecting members 3 includes the main body portion 31, and the main body portion 31 has a front edge, a rear edge and two side edges. The two wing portions 33 protrude from the front and rear edges of the main body portion 31, and the second strip connecting portion 32 protrudes from one of the side edges of the main body portion 31 along the lateral direction. The two second strip connecting portions 32 are both connected with a second strip 10. Further, the first strip connecting portion 26 is connected with a first strip 9. The pre-breaking portion 27 is connected with a strip bridge 101, and two ends of the strip bridge 101 respectively extend so as to be connected with the second strip 10. The second strip 10 is frame-shaped, and the first terminal group 2, the first strip 9 and the strip bridge 101 are surrounded within the second strip 10. A positioning hole 104 is formed in each of the first strip 9, the second strip 10 and the strip bridge 101, which is convenient to position a mold.

Figure 8:
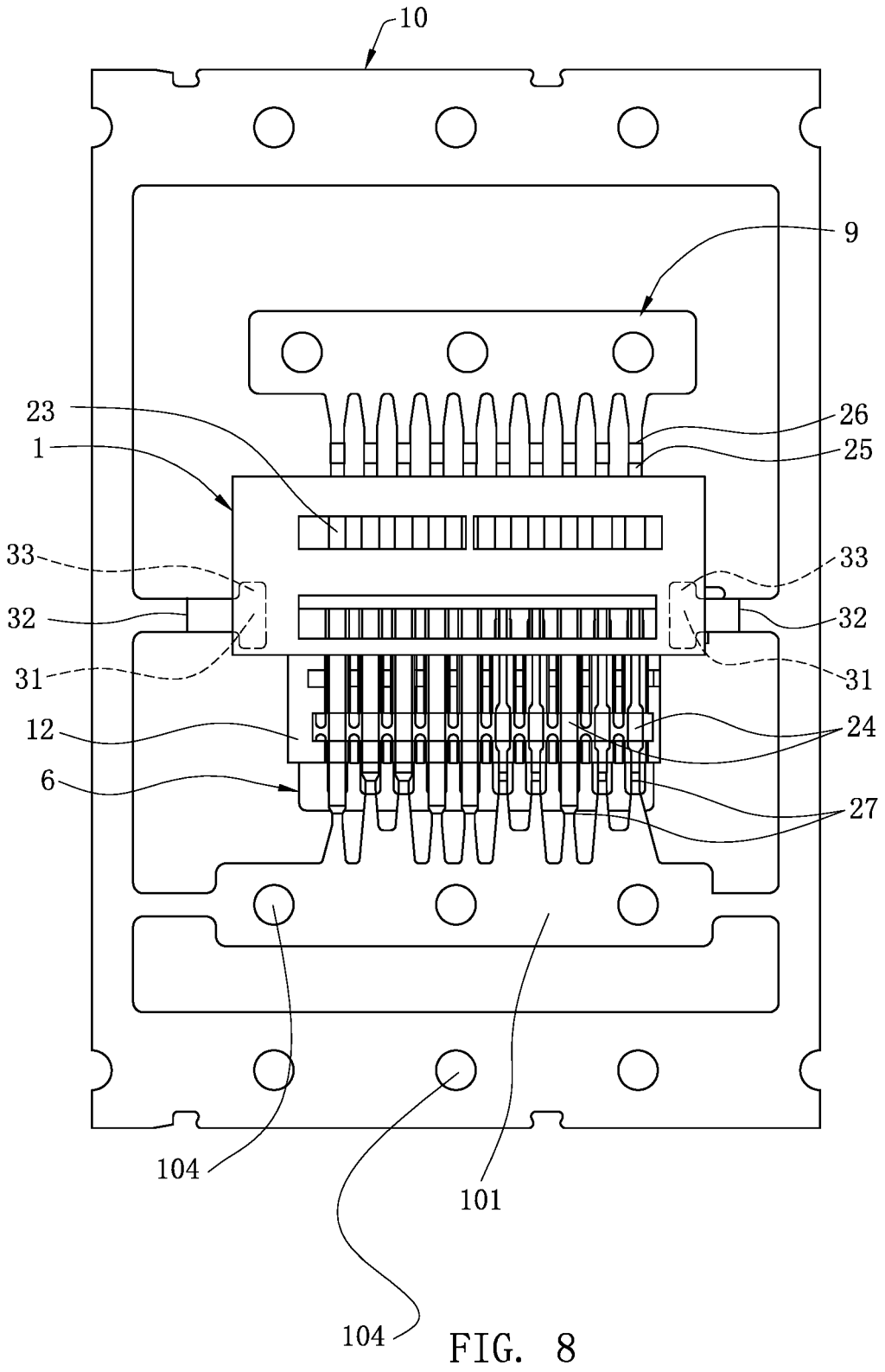
FIG. 8 is a structural schematic view of the insulating body being injection-molded on the first terminal group in step S2 according to the first embodiment of the present invention.

S2: the first terminal group 2 is bent. Firstly, the shielding sheet 6 and the first terminal group 2 are placed into a mold cavity. The first terminal group 2 connected with the first strip 9, the second strip 10 and the strip bridge 101 is placed above the shielding sheet 6. After positioning the strip bridge 101 and the second strip 10 in the mold cavity by the positioning holes 104 located below, the insulating body 1 is formed on the first terminal group 2 and the shielding sheet 6 by insert molding for a first time, so as to form a first terminal module. As shown in FIG. 8, the first soldering portion 25 protrudes out of the rear end of the base 11. The first contact portion 24 is exposed to the upper surface of the first tongue 12. The pre-breaking portion 27 protrudes out of the front end of the first tongue 12. The wing portions 33 are respectively embedded between the side edge of the base 11 and each of the first terminal and the last terminal of the first terminal group 2 adjacent to the wing portions 33. The stopping portion 13 is formed between each of the wing portions 33 and the side edge of the corresponding base 11 so as to stop the connecting members 3 from laterally sliding from the base 11 in the insert molding process. The other of the two sides of connecting member 3 is exposed to the corresponding side edge of the base 11, so the second strip connecting portion 32 is exposed to the side edge of the base 11. As shown in FIG. 9, providing another metal sheet, and manufacturing the second terminal group 4 by punching and blanking. The third strip connecting portion 43 is connected with a third strip 102. The front end of the second contact portion 42 is connected with a fourth strip 103. The positioning holes 104 convenient to position the mold are formed in the fourth strip 103. The second terminal group 4 is bent, and after placing the second terminal group 4 provided with the fourth strip 103 and the third strip 102 into a mold cavity and positioning the second terminal group 4, the insulating seat 5 is formed on the second terminal group 4 by insert molding, so as to form a second terminal module. The third strip connecting portion 43 protrudes out of the rear end of the base seat 51. The second contact portion 42 is exposed to the lower surface of the second tongue 52. The front end of the second contact portion 42 protrudes out of the front end of the second tongue 52. Then the fourth strip 103 and the third strip 102 are removed.

S3: the first strip 9 and the strip bridge 101 are removed.

Figure 11:
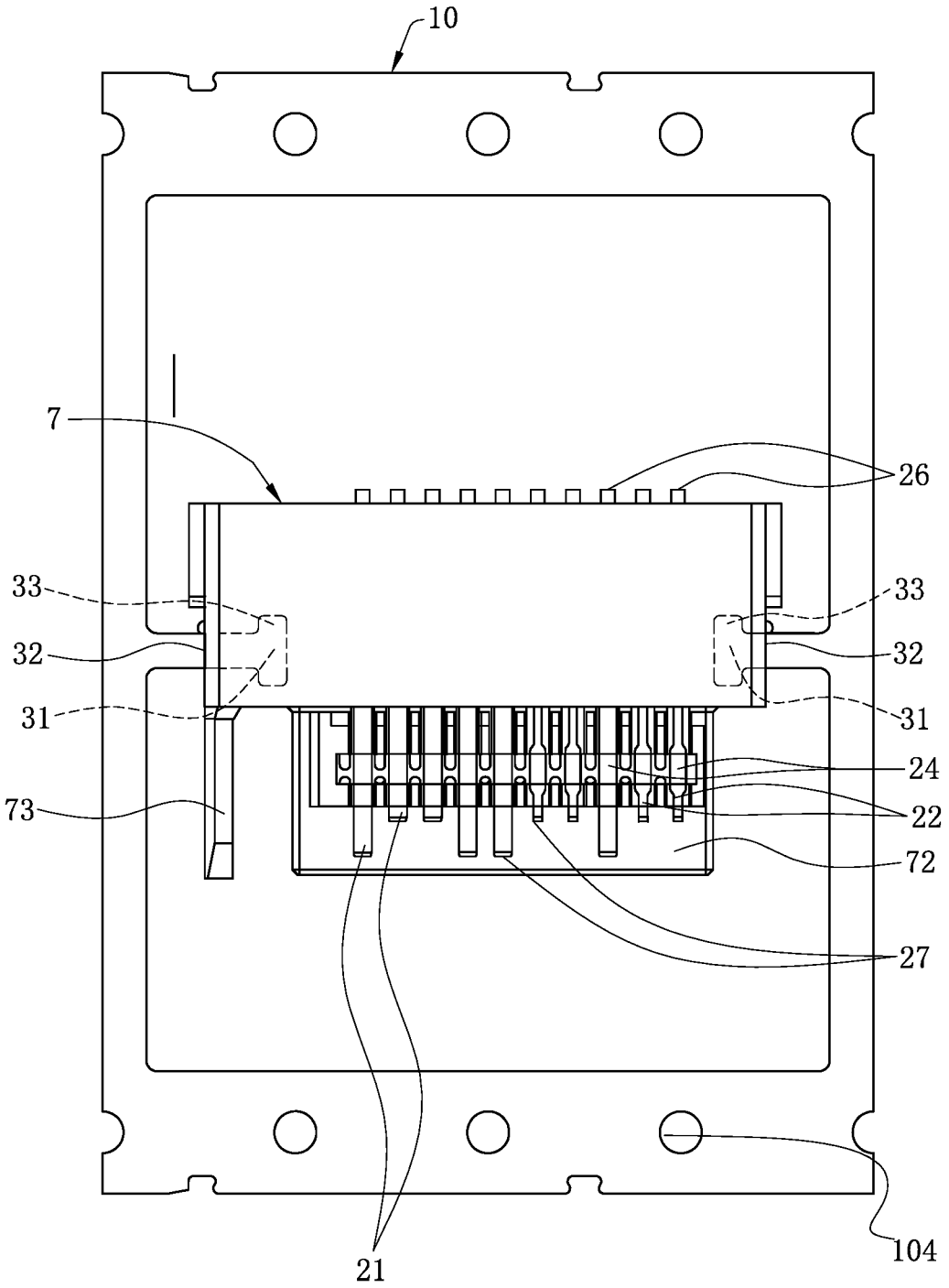
FIG. 11 is a structural schematic view of the insulating shell being injection-molded on the first terminal module and the second terminal module in step S2 according to the first embodiment of the present invention.

S4: as shown in FIG. 10 and FIG. 11, after fixing the first terminal module and the second terminal module in the mold cavity (in which the first terminal module is fixed in the mold cavity by the second strip 10), the insulating shell 7 is formed by over molding for a second time to cover the first terminal module and the second terminal module. The matrix 71 covers the base 11 and the base seat 51, such that the first strip connecting portion 26 and the third strip connecting portion 43 protrude out of the rear end of the matrix 71. The second strip connecting portion 32 is exposed to the side edge of the matrix 71. The third tongue 72 covers the first tongue 12 and the second tongue 52, such that the first contact portion 24 is exposed to the upper surface of the third tongue 72. The pre-breaking portion 27 protrudes out of the front end of the first tongue 12 and is embedded in the third tongue 72. The second contact portion 42 is exposed to the lower surface (not shown) of the third tongue 72.

S5: the second material strip 10 is removed, and the insulating shell 7 is accommodated in the shielding shell 8 to obtain a finished product.

To sum up, the electrical connector 100 according to certain embodiments of the present invention has the following beneficial effects:

1. The two connecting members 3 are respectively embedded between the two side edges of the insulating body 1 and the outer sides of the first terminal and the last terminal in the first terminal group 2, and the gap is formed between each of the two connecting members 3 and each of the first terminal and the last terminal. That is, the connecting members 3 are not in contact with the first terminal or the last terminal adjacent to the connecting members 3. Thus, the width of the first terminal or the last terminal is not increased, ensuring the high-frequency transmission rate of the first terminal group 2. Therefore, the electrical connector can be formed without affecting the transmission quality of the terminals, which is capable of facilitating machining, stable in structure and has high-frequency transmission performance.

2. The wing portions 33 protrude out of the front and rear edges of the main body portion 31. The base 11 is provided with the stopping portions 13 to stop the wing portions 33. Thus, the connecting members 3 are not pulled out of the insulating body 1 due to the action of an external force, such that the connecting members 3 can be better fixed in the base 11 without being detached away from the base 11.

3. The connecting member 3 is formed with the through hole 105. The engaging portion 106 is formed in the base 11 and is located in the through hole 105 so as to be relatively buckled with the inner wall of the through hole 105. Thus, the connecting members 3 are not pulled out of the insulating body 1 due to the action of an external force, such that the connecting members 3 can be better fixed in the base 11 without being detached away from the base 11.

4. The shielding sheet 6 is additionally provided between the first terminal group 2 and the second terminal, thus effectively reducing the signal crosstalk between the first terminal group 2 and the second terminal, and thereby improving the high-frequency performance of the electrical connector 100.

5. The widths of all portions of the signal terminals 21 on the first terminal group 2 maintain consistent, such that the signal terminals 21 can transmit equivalent high-frequency signals, thereby ensuring the high-frequency signal transmission capacity of the electrical connector 100.

6. The connecting members 3 and the first terminal group 2 are formed by punching the same metal sheet, such that the material is saved, and the early-stage machining is facilitated.

7. The protruding direction of the first strip connecting portion 26 is perpendicular to the protruding direction of the second strip connecting portion 32, allowing the connecting members 3 to be embedded between each of the two side edges of the insulating body 1 and the outer sides of the first terminal and the last terminal in the first terminal group 2.

8. In step S2, the strip bridge 101 is connected with the second strip 10. Thus, the strip bridge 101 and the second strip 10 are both fixed in the mold cavity, further strengthening the fixation of the first terminal group 2. The first terminal group 2 is not easily deviated in a primary insert molding process, thereby better embedding the first terminal group 2 in the insulating body 1.

9. In step S3, the pre-breaking portion 27 can be embedded in the third tongue 72 by firstly removing the strip bridge 101, such that the strip bridge 101 is easy to break without being retained on the third tongue 72 so as to facilitate subsequent machining, and ensuring the length of the pre-breaking portion 27 not to increase, and further ensuring the high-frequency signal transmission capacity of the electrical connector 100.

10. In step S4, the two connecting members 3 have been embedded in the insulating body 1, and the insulating body 1 can also be positioned after the second material strip 10 is fixed. Thus, the insulating body 1 can be better embedded in the insulating shell 7 during the secondary molding.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a first terminal group, having a plurality of terminals provided thereon;

an insulating body, covering the first terminal group by insert molding; and an insulating shell, integrally formed on and covering the insulating body, wherein at least one of the terminals on the first terminal group is provided with a first strip connecting portion protruding out of a rear end of the insulating body, a connecting member is provided between a first terminal or a last terminal of the terminals on the first terminal group and a corresponding side edge of the insulating body adjacent thereto, the connecting member and the first terminal group are made of a same material, a portion of the connecting member is embedded into the insulating body and another portion of the connecting member protrudes out of the corresponding side edge of the insulating body and is embedded into the insulating shell, the connecting member has two sides, one of the two sides of the connecting member is exposed to the corresponding side edge of the insulating body, a gap exists between the connecting member and the first terminal or the last terminal on the first terminal group adjacent to the other of the two sides of the connecting member in a lateral direction, and the connecting member has a second strip connecting portion exposed to a corresponding side edge of the insulating shell.

2. The electrical connector according to claim 1, wherein the connecting member has a main body portion and at least one wing portion protruding from the main body portion, and the insulating body is formed with a stopping portion between the wing portion and the corresponding side edge of the insulating body.

3. The electrical connector according to claim 2, wherein the wing portion is formed by protruding from at least one of a plurality of edges of the main body portion, the second strip connecting portion is formed by protruding from another one of the edges of the main body portion, and the wing portion and the main body portion are located on a same plane.

4. The electrical connector according to claim 2, wherein the connecting member has two wing portions, the two wing portions respectively protrude from a front edge and a rear edge of the main body portion, and two side edges of the insulating body are correspondingly provided with two stopping portions.

5. The electrical connector according to claim 2, wherein a protruding direction of the second strip connecting portion and a protruding direction of the wing portion are perpendicular to each other.

6. The electrical connector according to claim 1, wherein a protruding direction of the first strip connecting portion and a protruding direction of the second strip connecting portion are perpendicular to each other.

7. The electrical connector according to claim 1, wherein the connecting member and the first terminal group are formed by punching a same metal sheet.

8. The electrical connector according to claim 1, wherein the connecting member is provided with at least one through hole, and the insulating body is integrally formed with an engaging portion located in the through hole to stop the connecting member from detaching away from the corresponding side edge of the insulating body.

9. The electrical connector according to claim 1, wherein the insulating body comprises a base and a first tongue extending from the base, the first terminal group has a plurality of signal terminals and a plurality of ground terminals, and the first terminal or the last terminal on the first terminal group is one of the signal terminals.

10. The electrical connector according to claim 9, wherein structures of the signal terminals are identical, and structures of the ground terminals are identical.

11. The electrical connector according to claim 9, wherein each of the signal terminals has a retaining portion embedded in the base, the connecting member is located between the retaining portion and the corresponding side edge of the insulating body, and a width of the retaining portion of each of the signal terminals is identical.

12. The electrical connector according to claim 1, further comprising a second terminal group provided below the first terminal group, wherein an insulating seat covers the second terminal group by insert molding, the insulating seat is located at a bottom of the insulating body, and at least one of a plurality of terminals on the second terminal group is provided with a third strip connecting portion protruding out of a rear end of the insulating seat.

13. The electrical connector according to claim 12, further comprising a shielding sheet accommodated in the insulating body, wherein the shielding sheet is located below the first terminal group to be clamped between the first terminal group and the second terminal group, the connecting member is located above the shielding sheet, and a clearance exists between the connecting member and the shielding sheet in a vertical direction.

14. An electrical connector, comprising:

a first terminal group, having a plurality of terminals provided thereon;

a second terminal group provided below the first terminal group, having a plurality of terminals provided thereon; and an insulating body, covering the first terminal group by insert molding, wherein at least one of the terminals on the first terminal group is provided with a first strip connecting portion protruding out of a rear end of the insulating body, a connecting member is provided between a first terminal or a last terminal of the terminals on the first terminal group and a corresponding side edge of the insulating body adjacent thereto, the connecting member and the first terminal group are made of a same material, the connecting member is embedded into the insulating body and has two sides, one of the two sides of the connecting member is exposed to the corresponding side edge of the insulating body, a gap exists between the connecting member and the first terminal or the last terminal on the first terminal group adjacent to the other of the two sides of the connecting member in a lateral direction, the connecting member has a second strip connecting portion exposed to the corresponding side edge of the insulating body, an insulating seat covers the second terminal group by insert molding, and at least one of the terminals on the second terminal group is provided with a third strip connecting portion protruding out of a rear end of the insulating seat, wherein an insulating shell covers the insulating body and the insulating seat by over molding, at least one of the terminals on the first terminal group has a first contact portion exposed to an upper surface of the insulating shell, at least one of the terminals on the second terminal group has a second contact portion exposed to a lower surface of the insulating shell, the first strip connecting portion and the third strip connecting portion protrude out of a rear end of the insulating shell, and a front end of the insulating shell is provided with a foolproof member extending forward.

15. The electrical connector according to claim 14, wherein each of the first contact portions of the terminals on the first terminal group extends forward to form a pre-breaking portion to be connected to a strip bridge, and the pre-breaking portion is exposed out of the insulating body and is embedded in the insulating shell.

16. The electrical connector according to claim 14, wherein the insulating body comprises a base and a first tongue extending from the base, the first terminal group has a plurality of signal terminals and a plurality of ground terminals, the first terminal or the last terminal on the first terminal group is one of the signal terminals, the connecting member is flat plate shaped, and a front end and a back end of the connecting member are both located in the base.

17. A method of manufacturing an electrical connector, comprising:

step S1: providing a metal sheet, and manufacturing a first terminal group and at least one connecting member on the metal sheet by punching and blanking, wherein the connecting member is located at an outer side of a first terminal or a last terminal of a plurality of terminals on the first terminal group, a gap exists between the connecting member and the first terminal or the last terminal on the first terminal group adjacent to the connecting member, two ends of at least one of the terminals on the first terminal group are respectively provided with a pre-breaking portion and a first strip connecting portion, the first strip connecting portion is connected with a first strip, the pre-breaking portion is connected with a strip bridge, the connecting member has a second strip connecting portion and is connected with a second strip, and the strip bridge is connected with the second material strip;

step S2: after placing the first terminal group in a mold cavity and positioning the strip bridge and the second strip, forming an insulating body on the first terminal group and the connecting member by insert molding for a first time, wherein the connecting member is embedded between a corresponding side edge of the insulating body and the first terminal or the last terminal of the terminals on the first terminal group adjacent to the connecting member, the second strip connecting portion is exposed to the side edge of the insulating body, the pre-breaking portion is exposed to a front end of the insulating body, and the first strip connecting portion protrudes out of a rear end of the insulating body;

step S3: removing the strip bridge; and step S4: placing the insulating body and the first terminal group on a mold, and forming an insulating shell to cover the insulating body and the first terminal group by over molding for a second time, wherein the second strip connecting portion is exposed to a side edge of the insulating shell and the pre-breaking portion is embedded in the insulating shell.

18. The method according to claim 17, wherein:

in the step S1, the connecting member has a main body portion and at least one wing portion formed by protruding from at least one of a plurality of edges of the main body portion, and the second strip connecting portion is formed by protruding from another one of the edges of the main body portion; and in the step S2, the insulating body is formed with a stopping portion between the wing portion and the corresponding side edge of the insulating body.

19. The method according to claim 17, wherein:

in the step S2, a shielding sheet is provided below the first terminal group, and the shielding sheet and the first terminal group are embedded in the insulating body altogether; and in the step S4, the insulating shell covers the shielding sheet, the first terminal group and the insulating body.

20. The method according to claim 19, wherein:

prior to the step S4, a second terminal module is provided, and the second terminal module comprises a second terminal group and an insulating seat formed on the second terminal group by insert molding;

in the step S4, the insulating shell covers the first terminal group, the insulating body, the shielding sheet, the second terminal group and the insulating seat; and the method further comprises, after the step S4, a step S5: removing the second strip.

* * * * *